United States Patent [19]

Sakamaki et al.

[11] 4,276,007

[45] Jun. 30, 1981

[54] ROTARY PUMP WITH CARBON VANES AND AN ALUMINUM CYLINDRICAL SLEEVE IN THE HOUSING

[75] Inventors: Hiroshi Sakamaki, Utsunomiya; Toshiyuki Maeda, Agoe; Fumihiro Ushijima; Tadashi Saitou, both of Toyota, all of Japan

[73] Assignee: Toyota Jidosha Kogyo Kabushiki Kaisha, Toyota, Japan

[21] Appl. No.: 23,440

[22] Filed: Mar. 23, 1979

[30] Foreign Application Priority Data

May 24, 1978 [JP] Japan ..... 53/71013[U]

[51] Int. Cl.[3] ..... F04C 18/00; F04C 29/00

[52] U.S. Cl. ..... 418/152; 418/178

[58] Field of Search ..... 418/152, 178, 179; 29/156, 4 WL, 525

[56] References Cited

U.S. PATENT DOCUMENTS

| | | | |
|---|---|---|---|
| 2,312,655 | 3/1943 | Lauck | 418/179 |
| 2,380,287 | 7/1945 | Baumbach | 29/525 |
| 2,816,702 | 12/1957 | Woodcock | 418/179 |
| 3,191,852 | 6/1965 | Kaatz et al. | 418/179 |
| 3,552,895 | 1/1971 | Bayley | 418/178 |
| 3,708,867 | 1/1973 | Meserole | 29/525 |

FOREIGN PATENT DOCUMENTS

| | | | |
|---|---|---|---|
| 2348441 | 3/1975 | Fed. Rep. of Germany | 418/152 |
| 2166954 | 1/1977 | Fed. Rep. of Germany | 418/152 |
| 2272277 | 1/1976 | France | 418/178 |

*Primary Examiner*—John J. Vrablik

*Attorney, Agent, or Firm*—Sughrue, Rothwell, Mion, Zinn and Macpeak

[57] ABSTRACT

A rotary fluid pump having a rotor with carbon vanes disposed in a rotor chamber. A cylindrical aluminum sleeve is force fitted into a mating arrangement with the inner peripheral surface of the rotor housing. The aluminum sleeve reduces the friction between the housing and the vanes. The sleeve may be of the same axial length or shorter than the rotor housing. If it is equal end seal plates are employed to provide the necessary expansion gap or end washers are employed at the housing to increase the effective axial length.

10 Claims, 5 Drawing Figures

ROTARY PUMP WITH CARBON VANES AND AN ALUMINUM CYLINDRICAL SLEEVE IN THE HOUSING

BACKGROUND OF THE INVENTION

This invention relates to a housing of a rotary fluid pump, and more particularly, to a rotor housing of a rotary fluid pump having a plurality of vanes made of carbon.

Conventional rotor housings are made of cast iron, or is formed with chromium plating on the inner peripheral surface thereof, while the vanes adapted to slidingly contact the inner peripheral surface of the rotor housing are generally made of carbon in light of wear resistance and self-lubrication properties. However, the coefficient of friction defined between carbon and cast iron, or carbon and chromium is relatively large such as 0.15 and 0.16, respectively. This results in the vanes tending to be extremly worn that deteriorates sealability between vanes and the rotor housing. Generally, this condition reduces service life of the pump.

In order to overcome this drawback, a rotor housing made of aluminum or aluminum alloy has been proposed to allow sliding contact with the vanes made of carbon to thus provide a small coefficient of friction of 0.06 between aluminum (aluminum alloy) and carbon to reduce the amount of wear of the carbon vanes. However, since thermal expansion of aluminum is large, such a rotor housing may tend to expand along the axial direction thereof due to heat generation caused by the frictional contact between the housing and the vanes. This creates and increases disadvantageously the clearance between the side faces of the rotor and side surfaces of side housing to thereby deteriorate sealability therebetween.

SUMMARY OF THE INVENTION

It is therefore, an object of this invention to overcome the above-mentioned drawbacks and disadvantages and to provide an improved rotary fluid pump which reduces wear amount of vanes.

It is also an object of this invention to provide a fluid pump that has excellent sealability between side faces of the rotor and side housings and between the vanes and the rotor housing.

The objects according to this invention are attained by providing a sleeve made of aluminum or aluminum alloy on the inner peripheral surface of the rotor housing made of cast iron. The sleeve is force fitted with the inner peripheral surface of the rotor housing. Preferably, axial length of the sleeve is smaller than that of the rotor housing to form clearance spaces. Alternatively, clearance spaces are formed between the planner ends of the sleeve and the side faces of the side housings. The axial length of the clearance space corresponds to the thermal expansion amount of the sleeve, whereby the sleeve is expanded along the axial direction thereof but yet provides an excellent seal and minimizes the wear level of the vanes.

This invention will be described with reference to the accompanying drawings and description of the preferred embodiments that follows.

DETAILED DESCRIPTION OF THE PREFERRED EMBODIMENTS

Figure 1:
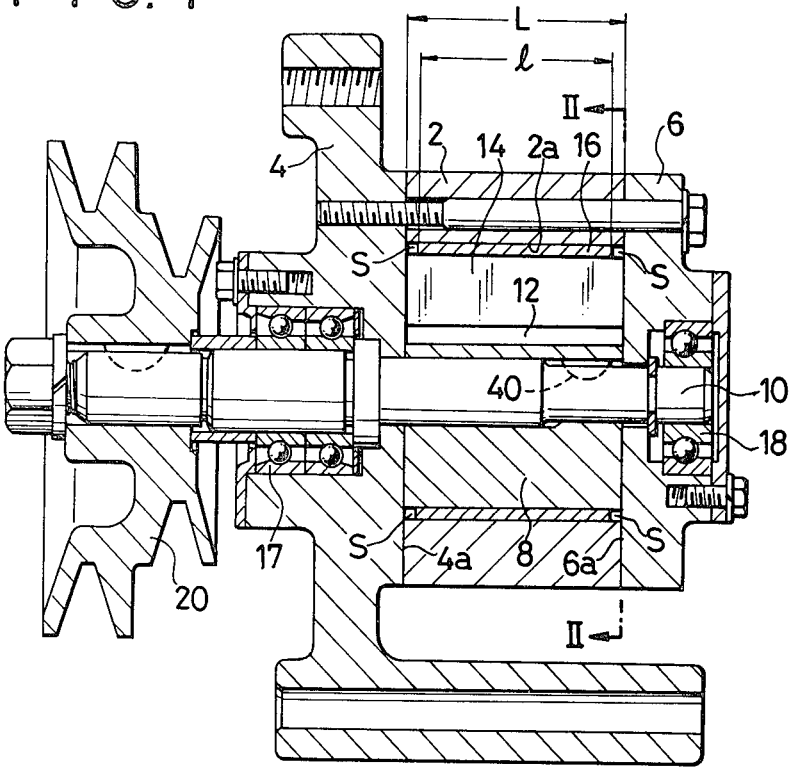
FIG. 1 is a cross-sectional elevation view of a rotary fluid pump according to a first embodiment of this invention.
Figure 2:
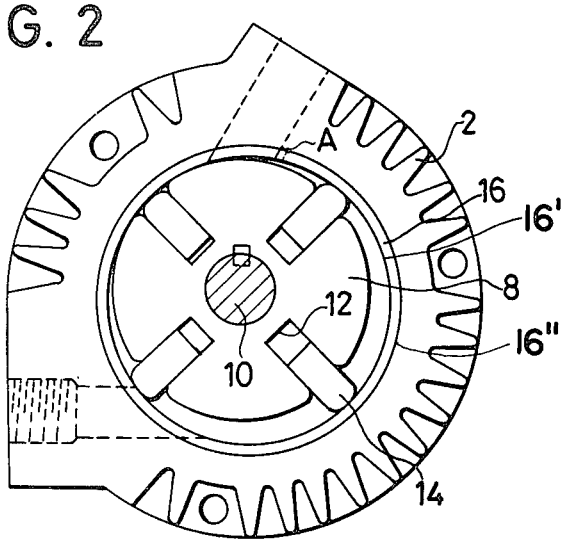
FIG. 2 is a cross-sectional view taken along the line II—II of FIG. 1 as viewed from the direction shown by an arrow.

A first embodiment of this invention is shown in FIGS. 1 and 2, wherein a rotor 8 is eccentrically mounted on a drive shaft 10 by a crescent key 40 in a rotor chamber defined by a rotor housing 2 and side housings 4, 6. Alternatively, the rotor is force fitted with the drive shaft, or is mounted on the shaft by a pin or adhesive materials. The drive shaft 10 is rotatably supported by bearings 17, 18 each disposed in the side housings 4, 6 respectively. The drive shaft 10 has one end connected to a V-pulley 20 to rotate the same.

A plurality of vane grooves 12 are radially formed in the rotor 8 to receive an equal plurality of vanes 14 made of carbon as shown in FIG. 2. The carbon vanes 14 slides radially outwardly in the grooves 12 by centrifugal force and fluid pressure due to the rotation of the rotor 8. In this case, side ends surfaces of the vanes 14 are in surface contact with inner surfaces 4*a*, 6*a* of the side housings 4, 6, and the radially outermost end surfaces of the vanes 14 are in surface contact with an inner peripheral surface of the rotor housing. As a result, the steps of fluid intake, compression and discharge are accomplished. in a well-known manner.

Reference numeral 16 designates a cylindrical sleeve made of aluminum or aluminum alloy force fitted with an inner peripheral surface 2*a* of the rotor housing 2. Therefore, the radially outermost end surfaces of the vanes are in surface contact with the sleeve 16. The coefficient of friction defined between the sleeve made of aluminum (aluminum alloy) and carbon vane is small, so that wear amount of the carbon vanes can be reduced to thus provide an excellent seal therebetween for a long period of time. Preferably, the axial length l of the sleeve 16 is smaller than the axial length L of the rotor housing 2 to provide spaces S, to thereby allow thermal expansion of the sleeve 16 along the axial direction thereof during high speed rotation of the rotor 8. Otherwise, (if the length l is equal to the length L) clearance may be generated between the side faces of the rotor and the side housings and/or between the sleeve and the vanes due to the thermal expansion of the sleeve to degrade sealability therebetween. The length differential (L−l) corresponds to the differential of the axial length of the sleeve before and after the thermal expansion thereof.

According to this invention, this length differential is in a range of $2.2/10^4$ to $6.6/10^3$ of the axial length of the rotor housing. The reason for this limitation is as follows.

If the length differential (clearance length) is less than $2.2/10^4$ of the axial length of the rotor housing, the sleeve may be deformed arcuately in cross section due to the thermal expansion in such a manner that longitudinal center portion of the sleeve is inwardly bent, so that only the longitudinal center portion of the vanes contact the sleeve, which degrades sealability between the sleeve and vanes. Or in case of FIG. 4 to be described later, the sleeve 16 may be projected into the side plates, which degrades sealability between the side face of the rotor and the side plate.

On the other hand, if the length differential is greater than $6.6/10^3$ of the axial length of the rotor housing, clearance still exists, since the axial thermal expansion of the sleeve does not fully occupy the clearance space.

Additionally, it is preferable to provide an anodic oxidation film 16' on the inner surface of the sleeve 16 in order to enhance the sliding characteristic of the carbon vanes to thus minimize the amount of wear of the vanes. That is, the film is of aluminum oxide obtained by electrolysis in which aluminum or aluminum alloy functions as the anode. The technique of anodic oxidation per se is well known in chemical field.

Furthermore, it is preferable that the outer peripheral surface 16'' of the sleeve 16 be subjected to knurling in order to prevent the sleeve from rotation in the housing during operation. Alternatively, the sleeve 16 is fixed to the housing by adhesive materials on the outer peripheral surface 16''.

Figure 3:
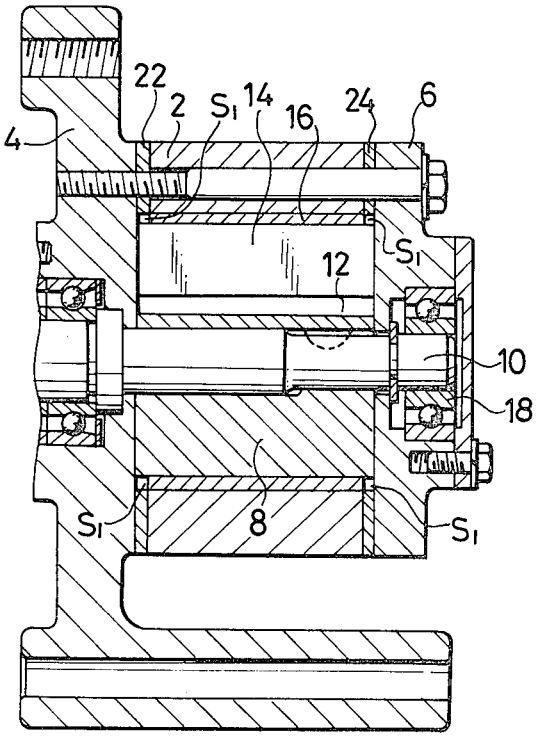
FIG. 3 is a cross-sectional elevation view of a rotary fluid pump according to a second embodiment of this invention.

A second embodiment of this invention is shown in FIG. 3, wherein like part and components are designated by the same reference numerals and characters as those shown in the first embodiment. In this embodiment, axial length of the sleeve is equal to that of the rotor housing 2, but a pair of washers 22, 24 are interposed between the rotor housing 2 and side housings 4, 6, respectively to provide clearance spaces $S_1$, respectively. The thickness of the washers corresponds to the amount of thermal expansion of the sleeve 6 along the axial direction thereof. This embodiment exhibits the same effect and function as those obtained in the first embodiment.

Figure 4:
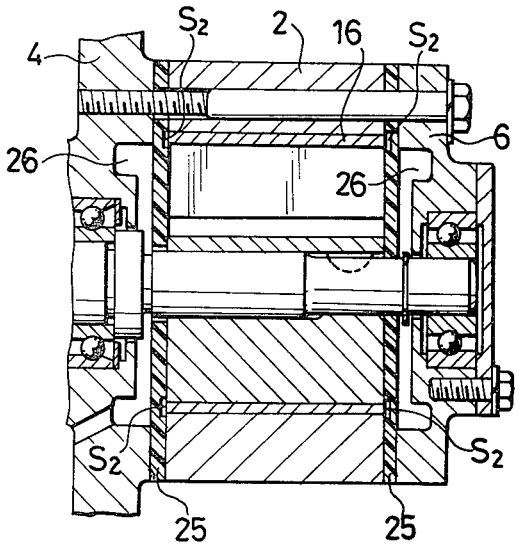
FIG. 4 is a cross-sectional elevation view of a rotary fluid pump according to a third embodiment of this invention.

A third embodiment of this invention is shown in FIG. 4, wherein a pair of seal plates 25, 25 are interposed between the rotor housing 2 and the side housings 4, 6, respectively. Additional end chambers 26, 26 is provided, each defined by a space between the side housing 4, 6, and seal plates 25, 25, respectively. In this type of rotary fluid pump, annular recesses $S_2$, $S_2$ are respectively formed in the seal plates 25, 25 at the position in alignment with the sleeve 16. The depth of the recesses corresponds to the amount of thermal expansion of the sleeve 16. This embodiment provides the same effect and function as those obtained in the first and second embodiments.

The features of this invention will now be described with reference to the specific experimental results that follows.

| details of a rotary fluid pump | | |
|---|---|---|
| rotor housing | inner diameter | 52 mm |
| | axial length | 40.030 mm |
| rotor | outer diameter | 48 mm |
| | axial length | 40 mm |
| | eccentricity | 2 mm |
| vane | numbers | 4 |
| | material | carbon |
| | axial length | 39.854 mm |
| | radial length | 14.955 mm |
| | thickness | 4.001 mm |
| seal plates | thickness | 2.5 mm |

-continued

| details of a rotary fluid pump | |
|---|---|
| reservior tank | 5 liter |

It should be noted that according to this pump, though axial length of the rotor housing is larger than that of the rotor and vanes, the clearance defined by the length differential would be occupied by the thermal expansion of the rotor and vanes.

Employing this rotary fluid pump, various kinds of rotor housings were prepared to investigate thermal load of each pump.

1. Sample 1

Prepared was a rotor housing made of aluminum alloy having an inner peripheral surface formed with anodic oxidation film.

2. Sample 2 (present invention)

Force fitted with an inner peripheral surface of the rotor housing made of cast iron is a cylindrical sleeve made of aluminum alloy formed with anodic oxidation film at the inner peripheral surface thereof. The axial length of the sleeve is 40.030 mm and thickness thereof is 2.0 mm.

3. Sample 3 (present invention)

Force fitted with an inner peripheral surface of the rotor housing made of cast iron is a cylindrical sleeve made of aluminum alloy formed with anodic oxidation film at the inner peripheral surface thereof. The axial length of the sleeve is 39.97 mm and the thickness thereof is 2.0 mm.

TESTING CONDITIONS

The pumps to be tested were placed at ambient room temperature. The rotation rate of the pump was increased to obtain the temperature of the rotor housing as shown in Table 1. The temperature of the rotor housing was measured at a position 2 mm from the inner peripheral surface thereof and 1 mm from a discharge port as at point A in FIG. 2. Thereafter, the pump rotation is reduced to 1000 r.p.m. to thus measure pump efficiency against thermal load. According to Table 1, the pump of sample 3 exhibits the most excellent efficiency, and the pump of sample 2 exhibits good efficiency. However, the pump of sample 1 cannot be placed in practical use. The r.p.m. number is much larger than 1000 r.p.m. in order to obtain the temperature of the rotor housing as listed below.

As is apparent from the Table 1, if the temperature is changed, (thermal load is applied to the pump), the pump efficiency is significantly changed in case of sample 1, whereas it is approximately maintained in the constant level in case of samples 2 and 3.

TABLE 1

| temperature | sample 1 | sample 2 | sample 3 |
|---|---|---|---|
| pump efficiency at 1000 r.p.m. (no thermal load is applied to the pump) | 640 mmHg | 640 mmHg | 640 mmHg |
| 112°-114° C. | 257 | 500 | 660 |
| 95°-100° C. | 278 | 553 | 655 |
| 76°-77° C. | 358 | 540 | 653 |
| 68°-70° C. | 393 | 543 | 650 |
| 60° C. | 493 | 577 | 648 |
| 50° C. | 527 | 576 | 645 |
| 37° C. | 584 | 607 | 643 |

Figure 5:
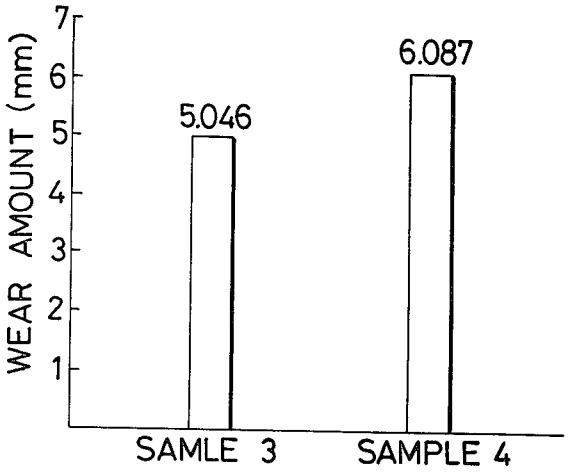
FIG. 5 is a graphical representation showing amount of wear of a vane along radial direction thereof.

Furthermore, a fourth sample was prepared to compare the wear amount of the vane along the radial direction thereof with that obtained in the sample 3 mentioned above. The fourth sample employs the above-mentioned rotary pump, in which the rotor housing is made of cast iron, and the inner peripheral surface is subject to chromium plating. These samples ran for 400 hours at 8000 r.p.m. and the wear amount of the vanes was measured as shown in FIG. 5. As is apparent from FIG. 5, the wear amount of vane of sample 3 is 5.046 mm whereas the wear amount of vane of sample 4 is 6.087 mm. Therefore, it is concluded that a pump having a rotor housing according to this invention incurs less amount of wear of the vanes than that in a conventional pump.

While the invention has been described in detail with reference to specific embodiments thereof, it will be apparent to one skilled in the art that various changes and modifications can be made therein without departing from the spirit and scope thereof. For example, the cylindrical sleeve can be positioned to contact one of planner end thereof with one of the side housings, and clearance space is provided between the other planner end of the sleeve and the other side housing.

What is claimed is:

1. In a rotary fluid pump including a rotor housing, a pair of side housings, said rotor housing and pair of side housings forming a rotor chamber, a rotor rotatably supported in said rotor chamber, a plurality of vanes slidably positioned in an equal number of grooves formed in said rotor, said vanes being made of carbon, the improvement comprising a cylindrical sleeve made of aluminum or aluminum alloy subject to anodic oxidation to obtain an oxide film on the inner peripheral surface of said sleeve; the rotor chamber having clearance spaces at its axial end portions and the ends of said sleeve adjacent said clearance spaces.

2. The device of claim 1, wherein outer peripheral surface of said sleeve is subject to knurling to enhance fitting with the inner peripheral surface of said rotor housing.

3. The device of claim 1, wherein adhesive material is formed between said sleeve and said rotor housing.

4. The device as claim 1, wherein axial length of said sleeve is less than the axial length of said rotor housing to form said clearance spaces, the axial length of said clearance spaces corresponding to an amount of thermal expansion of said sleeve.

5. The device of claim 2, wherein axial length of said clearance space is in the range of $2.2/10^4$ to $6.6/10^3$ of the axial length of said rotor housing.

6. The device of claim 1 wherein the axial length of said sleeve is equal to the axial length of said rotor housing.

7. The device of claim 6 further comprising a pair of end washers respectively interposed between said rotor housing and said side housings, wherein said axial clearance space corresponds to the thickness of the washers to compensate for thermal expansion of said sleeve is formed.

8. The device of claim 7 wherein the axial clearance space is in the range of $2.2/10^4$ to $6.6/10^3$ of the axial length of said rotor housing.

9. The device of claim 6 further comprising a pair of seal plates respectively interposed between the rotor housing and said side housings, each of said seal plates having an annular recess therein at a position in radial alignment with said sleeve.

10. The device of claim 9 wherein the depth of said annular recesses is the range of $2.2/10^4$ to $6.6/10^3$ of the axial length of said rotor housing.

* * * * *